US008134550B2

(12) United States Patent
Kim et al.

(10) Patent No.: US 8,134,550 B2
(45) Date of Patent: Mar. 13, 2012

(54) DISPLAY DEVICE, DRIVING METHOD THEREOF AND DISPLAY DRIVER THEREFOR

(75) Inventors: Do-ik Kim, Yongin-si (KR); Do-hyung Ryu, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1262 days.

(21) Appl. No.: 11/819,851

(22) Filed: Jun. 29, 2007

(65) Prior Publication Data

US 2008/0055289 A1 Mar. 6, 2008

(30) Foreign Application Priority Data

Aug. 30, 2006 (KR) ..... 10-2006-0083143

(51) Int. Cl.
*G09G 5/00* (2006.01)

(52) U.S. Cl. ..... 345/213; 345/530; 345/204; 348/567; 348/500; 348/513

(58) Field of Classification Search ..... 345/204, 345/87–100, 55, 76, 534, 535, 213; 348/500, 348/567, 513
See application file for complete search history.

(56) References Cited

U.S. PATENT DOCUMENTS

| | | | | |
|---|---|---|---|---|
| 5,801,718 | A | 9/1998 | Shimizu et al. | |
| 5,861,879 | A | 1/1999 | Shimizu et al. | |
| 6,441,863 | B1 | 8/2002 | Miyazaki et al. | |
| 6,594,331 | B1 * | 7/2003 | Soda | 375/376 |
| 6,700,571 | B2 * | 3/2004 | Nakatani et al. | 345/213 |
| 7,330,179 | B2 | 2/2008 | Endo et al. | |
| 2002/0063675 | A1 | 5/2002 | Furuhashi et al. | |
| 2003/0063077 | A1 | 4/2003 | Koyama | |
| 2004/0227764 | A1 * | 11/2004 | Endo | 345/534 |
| 2005/0168497 | A1 | 8/2005 | Kang | |
| 2006/0139343 | A1 | 6/2006 | Choi et al. | |

FOREIGN PATENT DOCUMENTS

| | | | |
|---|---|---|---|
| CN | 1409290 | A | 4/2003 |
| CN | 1 551 082 | A | 12/2004 |
| CN | 1 804 976 | A | 7/2006 |
| EP | 1 564 715 | A | 8/2005 |
| JP | 09-116874 | | 5/1997 |
| JP | 09-116875 | | 5/1997 |
| JP | 09-163182 | | 6/1997 |
| JP | 10-307562 | | 11/1998 |
| JP | 2000-010518 | A | 1/2000 |
| JP | 2002-287689 | A | 10/2002 |
| JP | 2004-163919 | A | 6/2004 |
| JP | 2005-027195 | A | 1/2005 |
| JP | 2006-078662 | A | 3/2006 |
| KR | 10-2000-0002532 | A | 1/2000 |
| KR | 10-2000-0070478 | A | 11/2000 |
| KR | 10-2005-0078332 | | 8/2005 |

* cited by examiner

*Primary Examiner* — Grant Sitta
(74) *Attorney, Agent, or Firm* — Lee & Morse, P.C.

(57) ABSTRACT

A digital driving system for a display includes a scan driver adapted to supply scan signals serially to scan lines of the display, a data driver adapted to supply a first data signal and a second data signal to data lines of the display, a timing controller adapted to control the scan driver and the data driver in accordance with a main clock, and to supply external data to the data driver, and a vertical synchronizing signal synchronizing circuit adapted to synchronize an internal vertical synchronizing signal and an external vertical synchronizing signal.

14 Claims, 7 Drawing Sheets

DISPLAY DEVICE, DRIVING METHOD THEREOF AND DISPLAY DRIVER THEREFOR

BACKGROUND OF THE INVENTION

1. Field of the Invention

Embodiments of the present invention relate to a display device, a method for digitally driving a display device and a display driver for a display device.

2. Description of the Related Art

Recently, various flat panel displays having reduced weight and volume compared with cathode ray tubes (CRTs) have been developed. Flat panel displays include liquid crystal displays (LCDs), field emission displays (FEDs), plasma display panels (PDPs), and organic light emitting displays.

Organic light emitting displays make use of organic light emitting diodes (OLEDs) that emit light by re-combination of electrons and holes. The organic light emitting display has advantages of high response speed and small power consumption.

A pixel of a conventional organic light emitting display may include an OLED and a pixel circuit, coupled to a data line Dm and a scan line Sn, to control the OLED, i.e., the OLED may generate light of a predetermined luminance corresponding to an electric current from the pixel circuit.

When a scan signal is supplied to the scan line, the pixel circuit may control an amount of an electric current provided to the OLED corresponding to a data signal provided to the data line Dm. To achieve this, the pixel circuit may include a transistor and a storage capacitor. The transistor may be coupled between a first power supply and the OLED. The OLED may be between a second power supply and the pixel circuit. The transistor may control an amount of an electric current flowing from the first power supply ELVDD to the second power supply ELVSS through the OLED according to the voltage stored in the storage capacitor. In practice, using an analog drive, the pixels should express a plurality of gradations using a constant voltage to be stored in the storage capacitor. However, because pixels of the conventional organic light emitting display express gradations using a voltage stored in the storage capacitor, exact expression of desired gradations may be difficult. Thus, in the conventional organic light emitting display, accurate brightness difference between adjacent gradations may not be expressed.

Further, in the conventional organic light emitting display, threshold voltage and electron mobility of the transistor may vary between pixels due to a process deviation. When deviations of the threshold voltage and electron mobility in the transistor occur, each pixel may generate light of different gradations in response to the same gradation voltage. Thus, the conventional organic light emitting display may not display an image of uniform luminance.

SUMMARY OF THE INVENTION

Embodiments of the present invention are therefore directed to a display device, a method for driving a display device and a display driver for a display device, which substantially overcome one or more of the problems due to the limitations and disadvantages of the related art.

It is therefore a feature of an embodiment of the present invention to synchronize the frame memories during alternating writing and reading operations.

It is therefore another feature of an embodiment of the present invention to provide a display, e.g., an organic light emitting display, a driving method thereof and a driver therefore, in which the external vertical synchronizing signal and the internal vertical synchronizing signal are in phase.

At least one of the above and other features and advantages of the present invention may be realized by providing a digital driving system for a display, including a scan driver adapted to supply scan signals serially to scan lines of the display, a data driver adapted to supply a first data signal and a second data signal to data lines of the display, a timing controller adapted to control the scan driver and the data driver in accordance with a main clock, and to supply external data to the data driver, and a vertical synchronizing signal synchronizing circuit adapted to synchronize an internal vertical synchronizing signal and an external vertical synchronizing signal.

The timing controller may include first and second frame memories adapted to alternately read and write the external data, a write memory control stage adapted to store external data in one of the first and second frame memories in accordance with the external vertical synchronizing signal, and a read memory control stage adapted to read stored data from another of the first and second frame memories in accordance with the internal vertical synchronizing signal. The first frame memory may be adapted to write, the second frame memory may be adapted to read, and vice versa.

The read memory control stage may be adapted to serve as a main counter and is adapted to supply the main clock to at least one of the data driver and the scan driver. The internal vertical synchronizing signal is generated in accordance with the main clock.

The read memory control stage may be adapted to supply the internal vertical synchronizing signal and a halved internal vertical synchronizing signal to the vertical synchronizing signal synchronizing circuit.

The vertical synchronizing signal synchronizing circuit may be adapted to determine a phase difference between the external vertical synchronizing signal and the internal vertical synchronizing signal, to control a frequency of the main clock in accordance with the phase difference, and to feedback a frequency controlled main clock to the timing controller. The timing controller may be adapted to generate the internal vertical synchronizing signal in accordance with the frequency controlled main clock.

The vertical synchronizing signal synchronizing circuit may be adapted to increase the frequency of the main clock when the external vertical synchronizing signal leads the internal vertical synchronizing signal control. The vertical synchronizing signal synchronizing circuit may be adapted to decrease the frequency of the main clock when the internal vertical synchronizing signal leads the external vertical synchronizing signal control.

The vertical synchronizing signal synchronizing circuit may include a first stage adapted to receive the external vertical synchronizing signal and to output a halved external vertical synchronizing circuit, a second stage adapted to receive the internal vertical synchronizing signal and a halved internal vertical synchronizing signal from the timing controller, and to output a shifted halved internal vertical synchronizing signal, a third stage adapted to determine a phase difference between the halved external vertical synchronizing signal and the shifted halved internal vertical synchronizing signal, and a fourth stage adapted to control a frequency of the main clock in accordance with the phase difference and to feedback the controlled main clock to the timing controller. The digital driving system may include a filter adapted to receive the phase difference from the third stage and output a DC component of the phase difference to the fourth stage.

The display may be an organic light emitting display.

At least one of the above and other features and advantages of the present invention may be realized by providing a method of controlling timing of reading and writing data for driving a display, including generating a halved external vertical synchronizing signal, generating a shifted halved internal vertical synchronizing signal, determining a phase difference between the halved external vertical synchronizing signal and the shifted halved internal vertical synchronizing signal, and controlling a frequency of a main clock in accordance with the phase difference such that the external vertical synchronizing signal and the internal vertical synchronizing signal are in phase.

Controlling the frequency of the main clock may include increasing the frequency of the main clock when the external vertical synchronizing signal leads the internal vertical synchronizing signal control and/or decreasing the frequency of the main clock when the internal vertical synchronizing signal leads the external vertical synchronizing signal control.

The method may further include filtering the phase difference and outputting a DC component of the phase difference before controlling the frequency.

At least one of the above and other features and advantages of the present invention may be realized by providing a display including a plurality of scan lines, a plurality of drive lines, a plurality of pixels at an intersection of corresponding scan and data lines, and a driver, the driver including a scan driver adapted to supply scan signals serially to scan lines of the display, a data driver adapted to supply a first data signal and a second data signal to data lines of the display, a timing controller adapted to control the scan driver and the data driver in accordance with a main clock, and to supply external data to the data driver, and a vertical synchronizing signal synchronizing circuit adapted to synchronize an internal vertical synchronizing signal and an external vertical synchronizing signal.

The pixels may include organic light emitting diodes.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
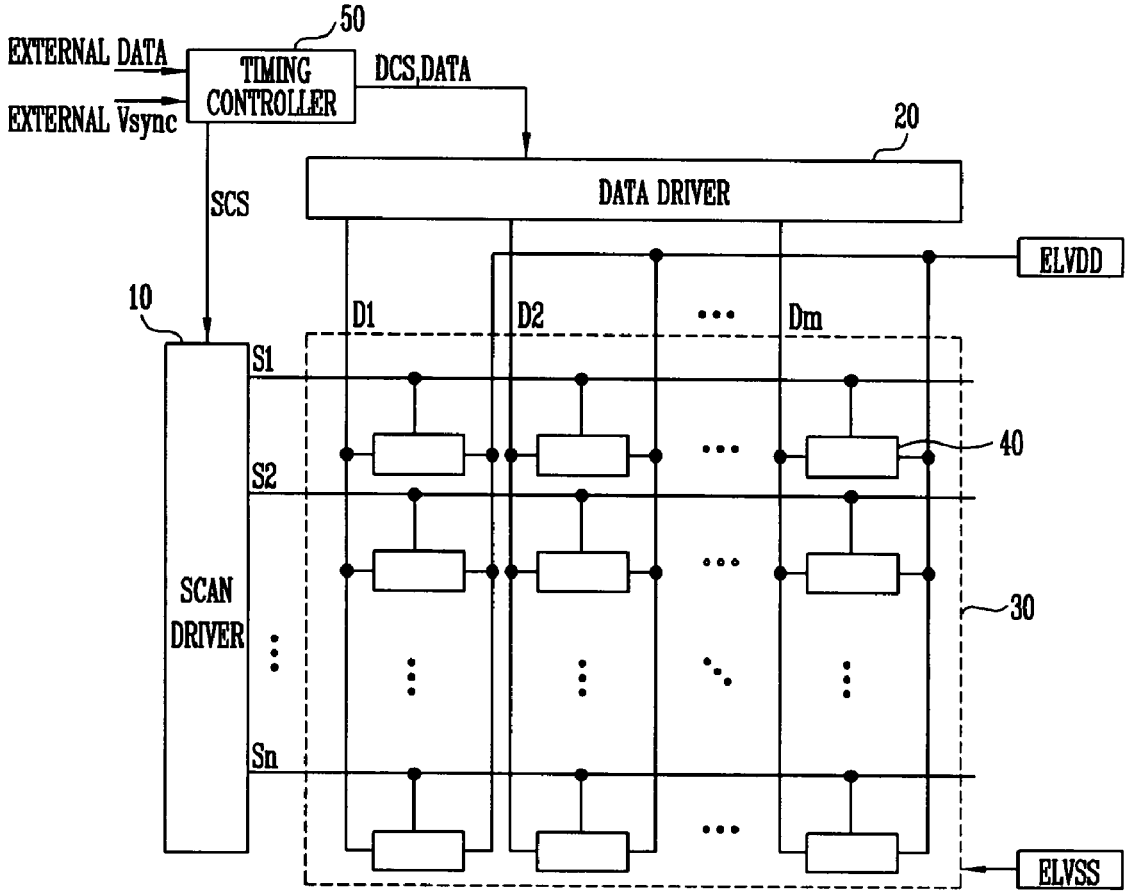
FIG. 1 illustrates a block diagram of an organic light emitting display device including a digital driving system.

Korean Patent Application No. 10-2006-0083143, filed on Aug. 30, 2006, in the Korean Intellectual Property Office, and entitled: "Organic Light Emitting Display Device and Driving Method Thereof," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Hereinafter, example embodiments according to the present invention will be described with reference to the accompanying drawings, namely, FIG. 1 to FIG. 7. When one element is coupled to another element one element may be not only directly coupled to another element, but also may be indirectly coupled to another element via another element. Further, irrelevant elements may be omitted for clarity. Also, like reference numerals refer to like elements throughout.

FIG. 1 illustrates an organic light emitting display according to an embodiment of the present invention.

With reference to FIG. 1, the organic light emitting display may include a pixel portion 30 having pixels 40, a scan driver 10, a data driver 20, and a timing control unit 50. The pixels 40 may be coupled to scan lines S1 through Sn and data lines D1 through Dm. The scan driver 10 may drive the scan lines S1 through Sn. The data driver 20 may drive the data lines D1 through Dm. The timing control unit 50 may control the scan driver 10 and the data driver 20.

The timing control unit 50 may generate a data driving signal DCS and a scan driving signal SCS corresponding to externally supplied synchronizing signals. The data driving signal DCS generated from the timing control part 50 may be provided to the data driver 20, and the scan driving signal SCS may be provided to the scan driver 10. Further, the timing control unit 50 may provide an externally supplied data DATA to the data driver 20.

The data driver 20 may supply a data signal to data lines D1 to Dm during every sub frame time period of a plurality of sub frame time periods included in one frame. The data signal may include a first data signal for a pixel 40 to emit light and a second data signal for the pixel 40 to not emit light. In other words, the data driver 20 may supply a first data signal or a second data signal, controlling emission or non-emission of the pixel 40, to data lines D1 to Dm every sub frame time period.

The scan driver 10 may sequentially provide a scan signal to scan lines S1 to Sn every sub frame period. When the scan signal is sequentially provided to the scan lines S1 to Sn, the pixels 40 may be sequentially selected by lines, and the selected pixels 40 may receive the first data signal or the second data signal from the data lines D1 to Dm.

The pixel portion 30 may receive power of the first power supply ELVDD and power of the second power supply ELVSS from the exterior, and may supply power to the pixels 40. After the pixels 40 receive the power of the first power supply ELVDD and the power of the second power supply ELVSS, when the scan signal is supplied, the pixels 40 may receive a data signal (the first data signal or the second data signal), and emit light or not according to the data signal. For example, when the scan signal is supplied, the pixels 40 having received the first data signal emit light during a corresponding sub frame period. In contrast to this, when the scan signal is supplied, the pixels 40 having received the second data signal do not emit light during a corresponding sub frame period. Of course, opposite logic may be used in accordance with a structure of the circuit controlling the pixels 40.

One frame 1F of the present invention may be divided into a plurality of sub frames SF1~SF8 to be driven by digital drive. Here, the respective sub frames SF1~SF8 may be divided into a scan period to sequentially supply a scan signal, an emission period to cause pixels 40 having received the first data signal during the scan period to emit light, and a reset period to cause the pixels 40 to be changed into a non-emission state.

During the scan period, the scan signal may be sequentially provided to the scan lines S1 to Sn. Also during the scan period, the first data signal or the second data signal may be supplied to respective data lines D1 to Dm. That is, the pixels 40 may receive the first data signal or the second data signal.

The pixels 40 emit light or not during the emission period while maintaining the first data signal or the second data signal supplied during the scan period. That is, the pixels 40 having received the first data signal during the scan period may be set in an emission state during a sub frame period, while the pixels 40 having received the second data signal may be set in a non-emission state during a corresponding sub frame period.

Different emission periods may be set according to respective sub frames. For example, in order to display an image with 256 gradations, one frame 1F may be divided into eight sub frames SF1~SF8. Further, the emission period of respective sub frames SF1 to SF8 of the emission period may be increased at the rate of $2^n$(n=0, 1, 2, 3, 4, 5, 6, 7) in the period. Namely, embodiments of the present invention may control emission or non-emission of pixels 40 based on respective sub frames SF1~SF8 to display an image of a predetermined gradation. In other words, embodiments of the present invention may express a predetermined gradation during one frame period using a sum of emission times by the pixels during the sub frame periods.

Since the aforementioned digital drive expresses gradations using a turning-on or turning-off state of a transistor, an image of uniform luminance may be displayed. Furthermore, because the present invention expresses gradations using a time division, i.e., a digital drive, more exact gradations may be expressed as compared with expressing gradations using a constant voltage range, i.e., an analog drive.

The timing controller 50 may include two frame memories (not shown), which alternately write and read. That is, during one frame, one frame memory may write externally supplied data, while the other frame memory may read and output stored data for a previous frame to the data driver 20.

The external data may be stored in the frame memory performing writing in accordance with the external vertical synchronizing signal, and stored data in the frame memory performing reading may be output to the data driver 20 in accordance with an internal vertical synchronizing signal, which, in turn, may output the data to the multiple pixels 40 in the pixel portion 30. The writing and reading may be performed alternately between the two frame memories.

However, if the external vertical synchronizing signal and the internal vertical synchronizing signal are not synchronized with each other, i.e., a phase difference occurs between the timing of the start and the end point of writing and reading, then portions of the image may be different or undefined, i.e., no data may be available for a particular pixel within a frame.

Figure 2:
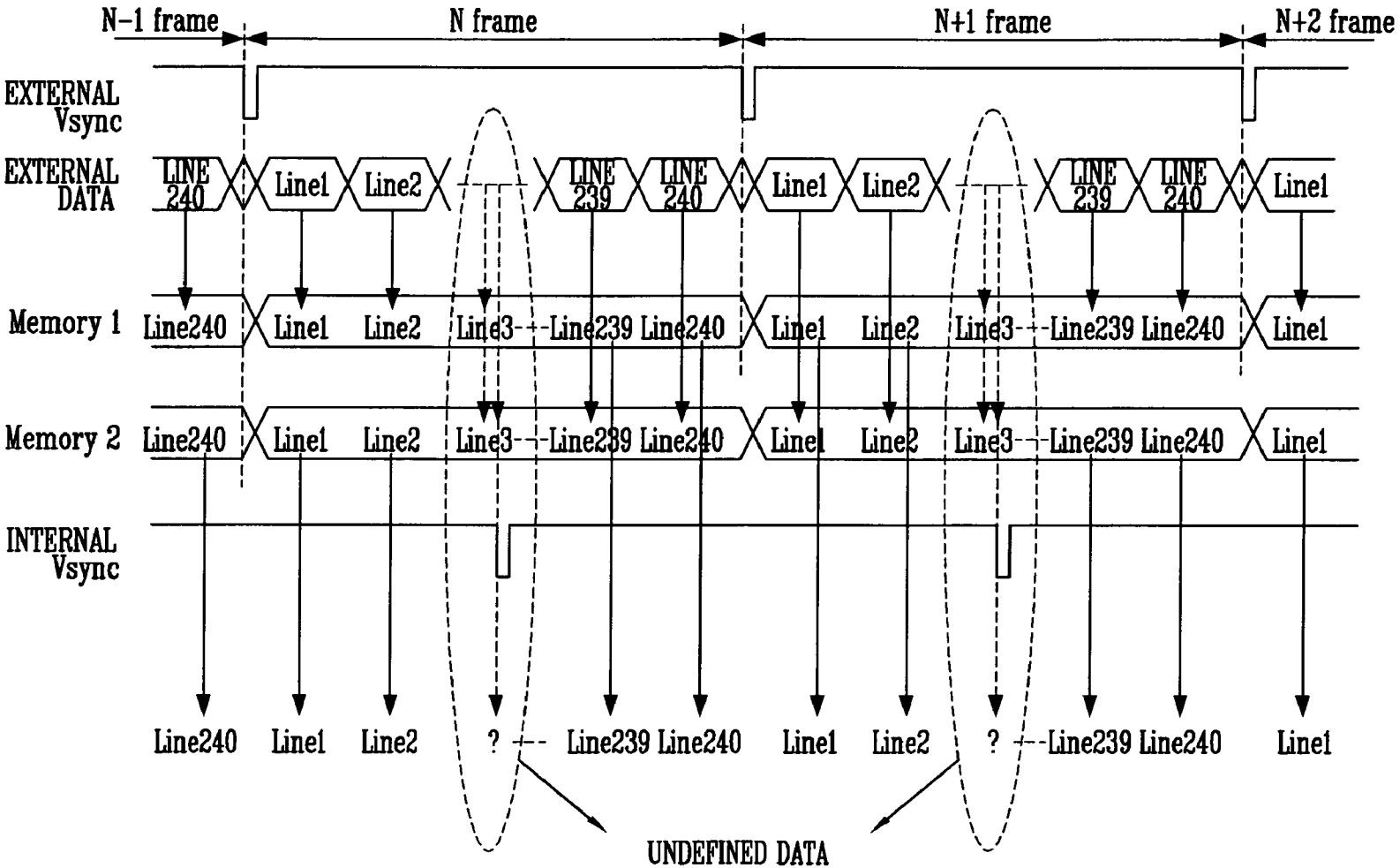
FIG. 2 illustrates a timing diagram describing problems arising from the external vertical synchronizing signal and internal vertical synchronizing signal being out of phase.

FIG. 2 illustrates a timing diagram for describing a problem arising when the external vertical synchronizing signal and the internal vertical synchronizing signal are out of phase.

As illustrated in FIG. 2, since a falling edge of the internal vertical synchronizing signal switches operation from writing to reading in each frame memory, if the external vertical synchronizing signal and the internal vertical synchronizing signal are out of phase, the timing of the start and the end point of the writing and the reading in the two frame memories may be different. Thus, part of an image may be incorrect or undefined.

Normally, during the N frame, the first frame memory (Memory 1) writing the external data in accordance with the external vertical synchronizing signal should switch to reading in the N+1 frame after finishing writing all external data. However, as illustrated in FIG. 2, if the internal vertical synchronizing signal is not synchronized with the external vertical synchronizing signal, a phase difference may arise. Thus, the first frame memory (Memory 1) may switch from writing to reading during the N frame. Then, the second frame memory (Memory 2) performing reading during the N frame in accordance with the internal vertical synchronizing signal may not have data to read. Thus, a portion of the image may be undefined. This problem may occur repeatedly, e.g., in every frame, as illustrated in FIG. 2, when the external vertical synchronizing signal is not synchronized with the internal synchronizing vertical signal.

An embodiment of the present invention may include a vertical synchronizing signal synchronizing circuit, coupled with a timing controller, to insure that the start and end points of the writing and reading in the two frame memories alternately performing the writing and reading are in phase.

Figure 3:
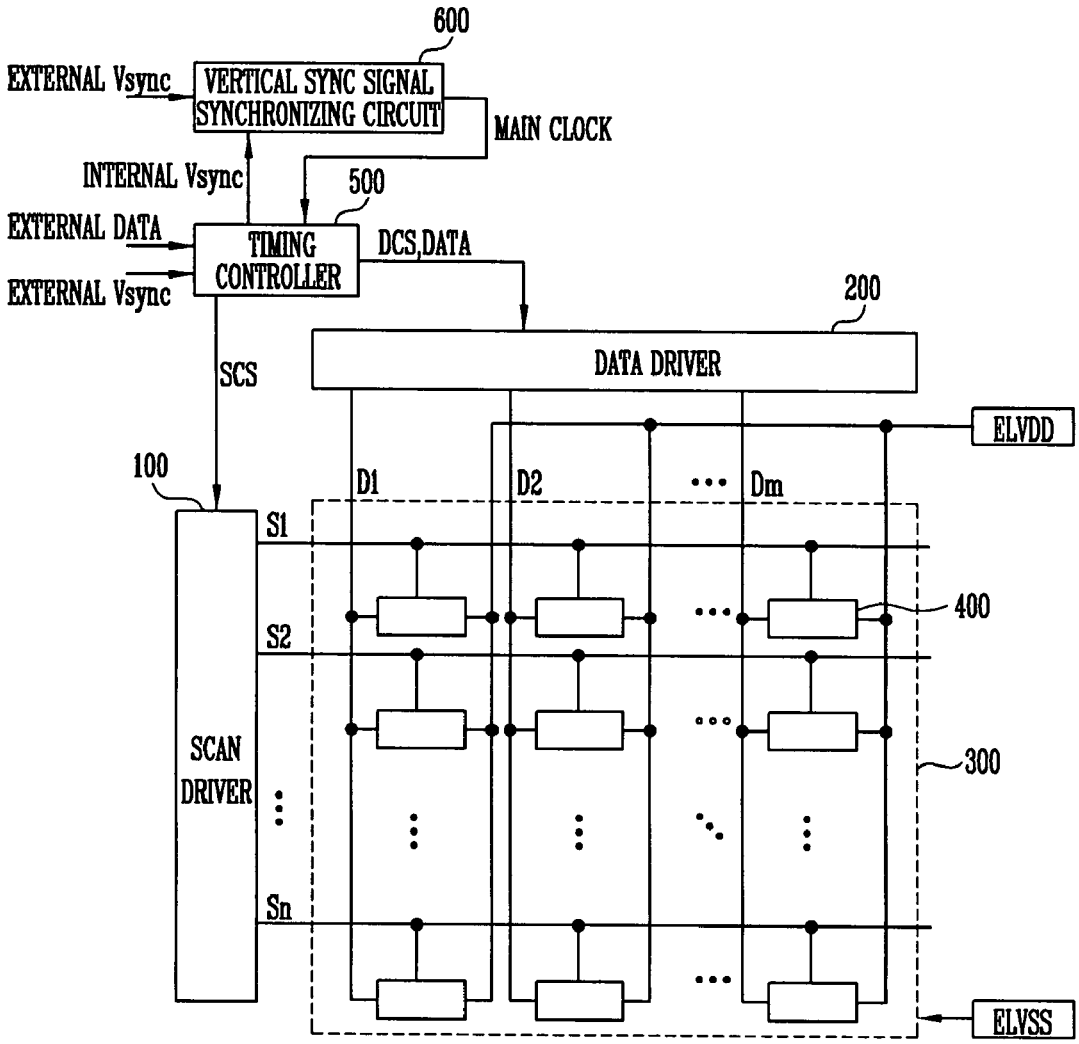
FIG. 3 illustrates a block diagram of an organic light emitting display device according to an embodiment of the present invention.

FIG. 3 illustrates a block diagram of an organic light emitting display according to an example embodiment of the present invention.

Referring to FIG. 3, an organic light emitting display may include a pixel portion 300, including the scan lines S1 to Sn, data lines D1 to Dm and multiple pixels 400, a scan driver 100 to drive the scan lines S1 to Sn, a data driver 200 to drive the data lines D1 to Dm, a timing controller 500 to control the scan driver 100 and the data driver 200, and a vertical synchronizing signal synchronization circuit 600 to make an internal vertical synchronizing signal (INTERNAL Vsync) and external vertical synchronizing signal (EXTERNAL Vsync) be in phase, i.e., make the write end time point and read start time for each of the frame memories in the timing controller 500 coincide.

The data driver 200 may supply a data signal to data lines D1 to Dm during every sub frame time period of a plurality of sub frame time periods included in one frame. The data signal may include a first data signal for a pixel 400 to emit light and a second data signal for THE pixel 400 to not emit light. In other words, the data driver 200 may supply a first data signal or a second data signal, controlling emission or non-emission of the pixel 400, to data lines D1 to Dm every sub frame time period.

The scan driver 100 may sequentially provide a scan signal to scan lines S1 to Sn every sub frame period. When the scan signal is sequentially provided to the scan lines S1 to Sn, the pixels 400 may be sequentially selected by lines, and the selected pixels 400 may receive the first data signal or the second data signal from the data lines D1 to Dm.

The pixel portion 300 may receive power of the first power supply ELVDD and power of the second power supply ELVSS from the exterior, and may supply power to the pixels 400. After the pixels 400 receive the power of the first power supply ELVDD and the power of the second power supply ELVSS, when the scan signal is supplied, the pixels 400 may receive a data signal (the first data signal or the second data signal), and emit light or not according to the data signal. For example, when the scan signal is supplied, the pixels 400 having received the first data signal emit light during a corresponding sub frame period. In contrast to this, when the scan signal is supplied, the pixels 400 having received the second data signal do not emit light during a corresponding sub frame period. Of course, opposite logic may be used in accordance with a structure of the circuit controlling the pixels 400.

The timing control unit 500 may generate a data driving signal DCS and a scan driving signal SCS corresponding to externally supplied synchronizing signals. The data driving signal DCS generated from the timing control part 50 may be provided to the data driver 200, and the scan driving signal SCS may be provided to the scan driver 100.

The timing controller 500 may further supply external data DATA in accordance with the external vertical synchronizing signal (EXTERNAL Vsync) to the data driver 200. Thus, the two frame memories (not illustrated) in the timing controller 500 may perform writing and reading alternately. Thus, during one frame period, one frame memory may write the external data, while the other frame memory may read the stored data and may output it to the data driver 200.

The external data may be synchronized by the external vertical synchronizing signal and stored in the memory frame performing writing, while the data drive device 200 may be synchronized by the internal vertical synchronizing signal and may read the stored data from the frame memory performing reading and may output the data to the multiple pixels 400 in the pixel portion 300. These writing and reading may be performed alternately in between the two frame memories.

As described above, if the external vertical synchronizing signal is not synchronized with the internal vertical synchronizing signal, i.e., a phase difference exists between the external and internal vertical synchronizing signal, the start and the end point of the two frame memories may be different and a potion of the image may be undefined. However, the vertical synchronizing signal synchronizing circuit 600 according to embodiments of the present invention may synchronize the internal vertical synchronizing signal to be in phase with the external vertical synchronizing signal. In particular, the vertical synchronizing signal synchronizing circuit 6200 may receive the external vertical synchronizing signal and the internal vertical synchronizing signal, may determine a phase difference between the external and internal vertical synchronizing signals, and may feedback a controlled main clock, i.e., controller in accordance with the phase difference, to the timing controller 500. The internal vertical synchronizing signal may be generated in accordance with the main clock.

Figure 4:
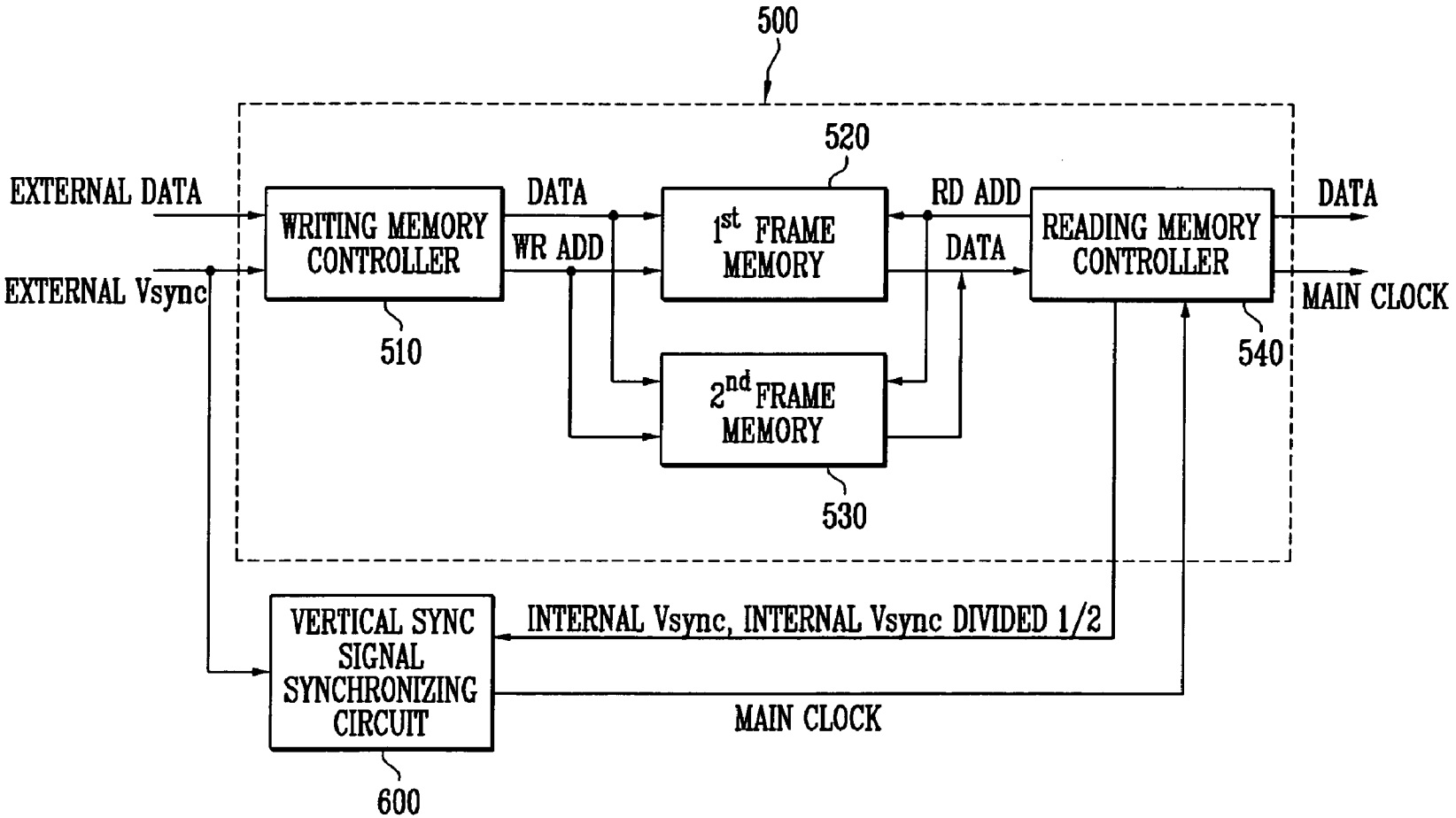
FIG. 4 illustrates a block diagram of the timing controller shown in FIG. 3 in detail.

A detailed description of an embodiment of the timing controller 500 and vertical synchronizing signal synchronizing circuit 600 in FIG. 4, illustrated in FIG. 4 and FIG. 5, respectively, will be provided below.

In FIG. 4, the timing controller 500 may include a writing memory controller 510, a first frame memory 520, a second frame memory 530, and a reading memory controller 540. The writing memory controller 510 may store the external data in accordance with the external vertical synchronizing signal (EXTERNAL Vsync) in the first frame memory 520. The reading memory controller 540 may read the data stored in the second frame memory 530 and may output the data to the data driver (200 in FIG. 3), in accordance with the internal vertical synchronizing signal (INTERNAL Vsync). The first and the second frame memories 520, 530 may alternately perform writing and reading.

The writing memory controller 510 may receive the external data synchronized with the external vertical synchronizing signal and the internal vertical synchronizing signal, and may store the external data in the frame memory performing the writing action. The writing memory controller 510 may provide the frame memory performing writing with an address signal WR ADD produced by the external vertical synchronizing signal. Thus, the frame memory may be synchronized with the external vertical synchronizing signal and may store the data defined in one frame.

Here, the frame memory may be the first and the second frame memory 520, 530. When the first frame memory 520 performs writing, the second frame memory 530 performs reading, and conversely, when the first frame memory 520 performs reading, the second frame memory 530 performs writing.

The reading memory controller 540 may provide the frame memory performing reading with an address signal RD ADD produced by the internal vertical synchronizing signal, may read the stored data from the previous frame in the frame memory, and may output it to the data driver (200 in FIG. 3).

The reading memory controller 540 may serve as a main counter, i.e., may provide the driving circuit of the panel with the main clock. The internal vertical synchronizing signal may be generated from the main clock.

The internal vertical synchronizing signal (Vsync) may be synchronized with the phase of the external vertical synchronizing signal (Vsync) by way of the vertical synchronizing signal synchronizing circuit 600, i.e., the internal and external vertical synchronizing signals may be in phase.

To do this, the reading memory controller 540 may provide the vertical synchronizing signal synchronizing circuit 600 with the internal vertical synchronizing signal and a halved internal vertical synchronizing signal, and may compare its phase with that of the external vertical synchronizing signal. Then, the vertical synchronizing signal synchronizing circuit 600 may control the frequency of the main clock to produce the internal vertical synchronizing signal in phase with the external vertical synchronizing signal, and may feedback the frequency controlled main clock to the reading memory controller 540.

Since the internal vertical synchronizing signal used to read the data stored in the frame memory has no phase difference with the external vertical synchronizing signal in writing the data in the frame memory within the reading memory controller 540, the start and the end points of writing and reading may be the same, preventing or reducing undefined portions in an image.

Figure 5:
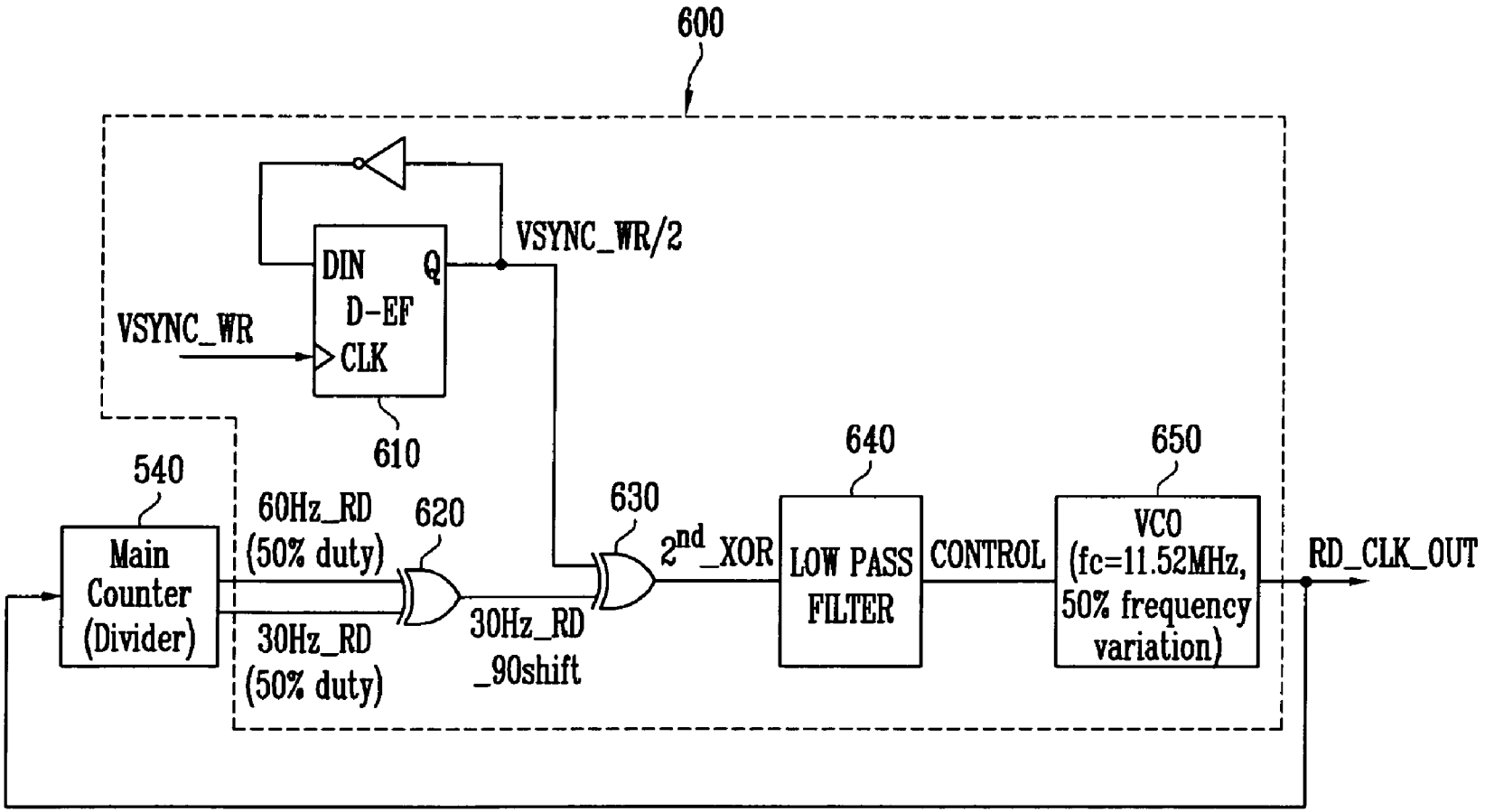
FIG. 5 illustrates a block diagram of the vertical synchronizing signal synchronization circuit shown in FIG. 3.
Figure 6:
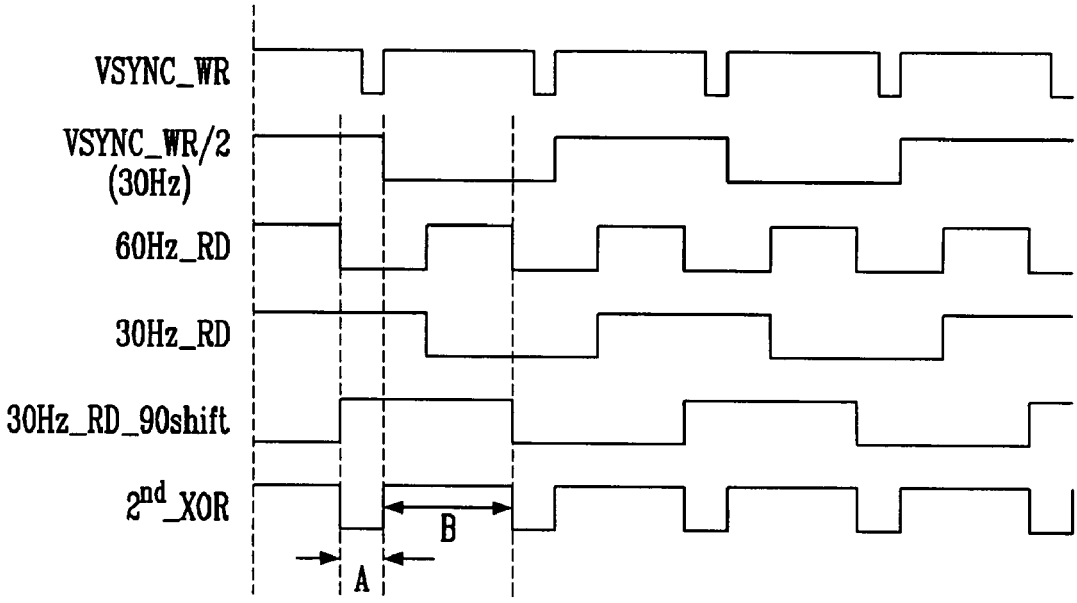
FIG. 6 illustrates a driving wave form diagram of the vertical synchronizing signal synchronization circuit shown in FIG. 5.

FIG. 5 illustrates a block diagram of the synchronization circuit of the vertical synchronizing signal synchronizing circuit 600 shown in FIGS. 3 and 4. FIG. 6 illustrates a driving waveform diagram of the vertical synchronizing signal synchronizing circuit 600 shown in FIG. 5.

In FIGS. 5 and 6, the external vertical synchronizing signal will be referred to as VSYNC_WR, the halved external vertical synchronizing signal will be referred to as VSYNC_WR/2, the internal vertical synchronizing signal will be referred to as 60HZ_RD, the halved internal vertical synchronizing signal will be referred to as 30HZ_RD, a shifted halved internal vertical synchronizing signal will be referred to as 30HZ_RD_90shift, and the main clock signal will be referred to as RD_CLK_OUT.

As illustrated in FIG. 5, the vertical synchronizing signal synchronizing circuit 600 may include a D flip-flop 610, a first XOR gate 620, a second XOR 630, a low pass filter (LPF) 640, and a voltage control oscillator (VCO) 650. The D flip-flop 610 may receive the external vertical synchronizing signal, divide it in half, and output the halved external vertical signal to the second XOR gate 630. The first XOR gate 620 may receive the internal vertical synchronizing signal and the halved internal vertical synchronizing signal from the reading memory controller 540, may shift the halved internal vertical synchronizing signal by 90 degrees and may output the shifted halved internal vertical synchronizing signal to the second XOR gate 630.

The second XOR gate 630 may compare the phase of the shifted halved internal vertical synchronizing signal received from the first XOR gate 620 with the phase of halved external vertical signal received from the D flip-flop 610. The oscillation frequency of the VCO 650 may be controlled in accordance with the result of the comparison output by the second XOR gate 630.

Thus, generally, the vertical synchronizing signal synchronizing circuit 600 according to embodiments may compare the phase difference of the external vertical synchronizing signal (VSYNC_WR) with that of the internal vertical synchronizing signal (60Hz_RD) from the internal main counter of the timing controller, i.e., the reading memory controller 540, and may control the main clock frequency to render these two signals in phase.

In particular, the D-flip flop 610 may receive the external vertical synchronizing signal VSYNC_WR, divide the signal VSYNC_WR in half, and output the signal VSYNC_WR2, which has a 50% duty cycle and a frequency of, e.g., 30 Hz. To generate the signal 30Hz_RD__90shift, the first XOR gate 620 may receive the two internal signals 60Hz_RD and 30Hz_RD, both having 50% duty cycles. Then, the output signal VSYNC_WR/2 of the D-flip flop 610 and that the output signal 30Hz_RD__90shift of the first XOR gate 620 may be input to the second XOR gate 630. A signal $2^{nd}$_XOR output from the second XOR gate 630 represents a phase difference between the two signals input thereto.

The low pass filter 640 may receive the signal $2^{nd}$_XOR from the second XOR gate 630 and may output only a direct current (DC) component of the signal $2^{nd}$_XOR to the VCO 650. The VCO 650 may output the clock signal RD_CLK_OUT in accordance with the DC component.

The operation of the vertical synchronizing signal synchronizing circuit 600 of FIG. 5 may be further illustrated by the waveforms in FIG. 6.

When the phase of the signal VSYNC_WR/2 is ahead of that of the signal 30Hz_RD__90shift, the frequency control voltage input to the VCO 650 is positive, and the frequency of the clock signal RD_CLK_OUT output by VCO 650 is increased to be in phase with the signal VSYNC_WR/2. Conversely, when the phase of the 30Hz_RD__90shift is ahead of that of the signal VSYNC_WR/2, the frequency control voltage of the VCO 650 is negative, and the frequency of clock signal RD_CLK_OUT output by the VCO 650 is reduced to be in phase with the signal VSYNC_WR/2.

As previously described, the external data may be input to the writing memory controller (510 of the FIG. 4) in accordance with the signal VSYNC_WR, and the reading memory controller 540 may read and output the stored data to each pixel in accordance with the signal 60Hz_RD. By feeding back the main clock controlled by the vertical sync signal synchronizing circuit 600 to the main counter 540 of the timing controller 500, i.e., the reading memory controller 540, the internal vertical synchronizing signal may be in phase with the external vertical synchronizing signal. Thus, in the two different frame memories, the start and the end point of the writing and reading may be in agreement and the image may always be defined.

When phases of the signal VSYNC_WR/2 and the signal 30Hz_RD__90shift coincide, a ratio of a low signal duration (A) to a high signal duration (B) in the output signal $2^{nd}$_XOR is 50%, i.e., A=B. When the phase of the signal VSYNC_WR/2 is leading, A<B, and when the signal 30Hz_RD is leading, A>B.

Figure 7:
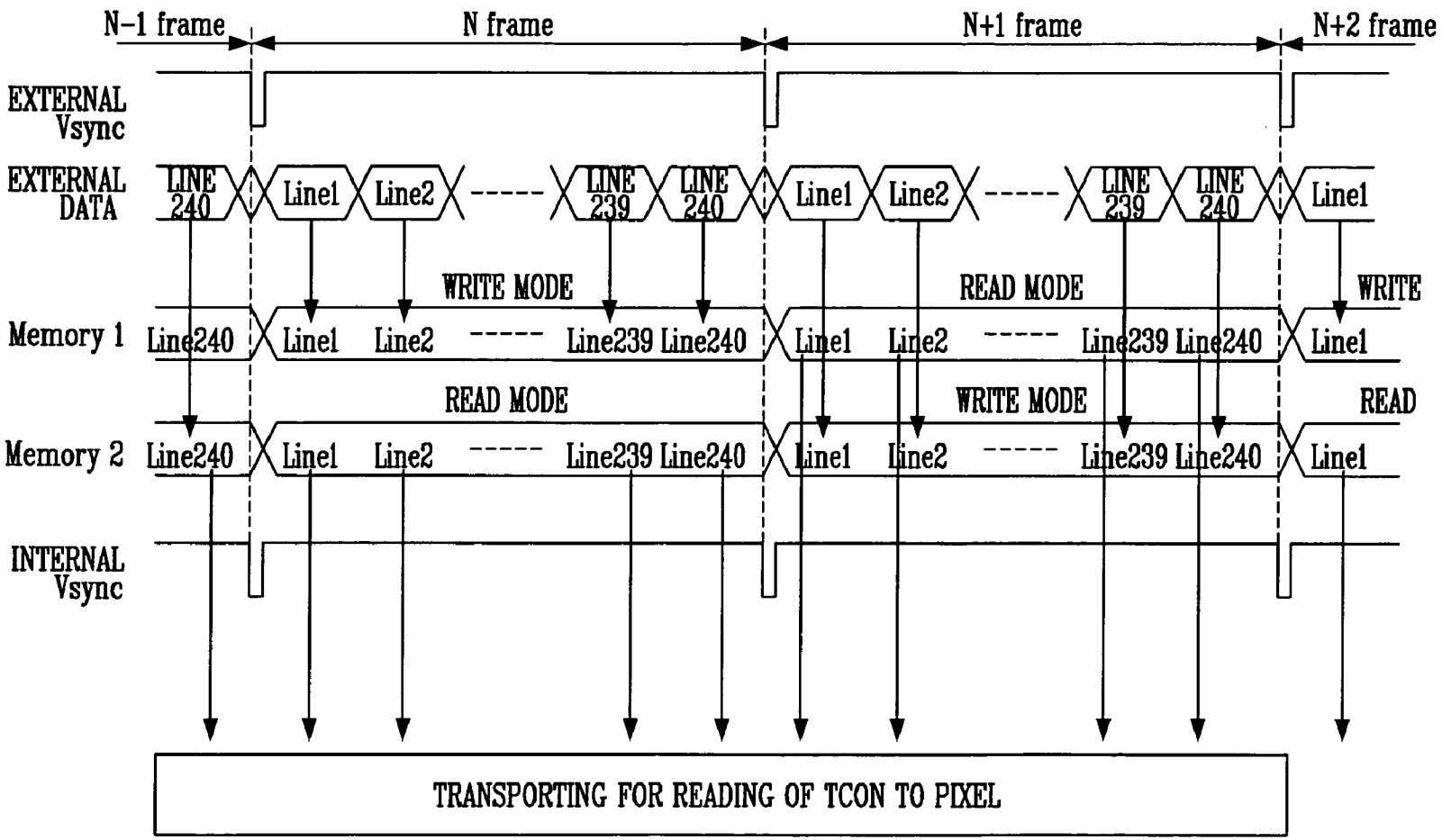
FIG. 7 illustrates a timing diagram when the external vertical synchronizing signal and internal vertical synchronizing signal are in phase.

FIG. 7 illustrates a timing diagram of signals when the external vertical synchronizing signal and the internal vertical synchronizing signal are in phase.

As illustrated in FIG. 7, when the external vertical synchronizing signal and the internal vertical synchronizing signal are in phase, the writing/reading action of the each frame memory may start and end at the same time. Therefore, the picture shown in each frame may be displayed without a problem.

Thus, the first frame memory performing writing of the external data in the N frame may switch to reading in the N+1 frame after writing all data during the N frame, and the second frame memory performing reading during in the N frame may switch to writing in the N+1 frame after reading all stored data in the N frame. Since the internal vertical synchronizing signal has the same timing as the external vertical synchronizing signal, the reading and writing of the frame memories may be simultaneously switched, i.e., reading and writing may be successfully alternately performed by the two frame memories.

According to embodiments, the two memory frames may alternately perform writing and reading, and the start and the end point of writing and reading may always or substantially always coincide or substantially coincide, thereby avoiding undefined portions of the image.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A digital driving system for a display, comprising:

a scan driver adapted to supply scan signals serially to scan lines of the display;

a data driver adapted to supply a first data signal and a second data signal to data lines of the display;

a timing controller adapted to control the scan driver and the data driver in accordance with a main clock, and to supply external data to the data driver; and a vertical synchronizing signal synchronizing circuit adapted to synchronize an internal vertical synchronizing signal and an external vertical synchronizing signal, wherein the vertical synchronizing signal synchronizing circuit includes:

a first stage adapted to receive the external vertical synchronizing signal and to output a halved external vertical synchronizing signal, a second stage adapted to receive the internal vertical synchronizing signal and a halved internal vertical synchronizing signal from the timing controller, and to output a shifted halved internal vertical synchronizing signal, a third stage adapted to determine a phase difference between the halved external vertical synchronizing signal and the shifted halved internal vertical synchronizing signal, and a fourth stage adapted to control a frequency of the main clock in accordance with the phase difference and to feedback the controlled main clock to the timing controller.

2. The digital driving system as claimed in claim 1, wherein the timing controller comprises:

first and second frame memories adapted to alternately read and write the external data;

a write memory control stage adapted to store external data in one of the first and second frame memories in accordance with the external vertical synchronizing signal; and a read memory control stage adapted to read stored data from another of the first and second frame memories in accordance with the internal vertical synchronizing signal.

3. The digital driving system as claimed in claim 2, wherein, when the first frame memory is adapted to write, the second frame memory is adapted to read, and when the first frame memory is adapted to read, the second frame memory is adapted to write.

4. The digital driving system as claimed in claim 2, wherein the read memory control stage is adapted to serve as a main counter and is adapted to supply the main clock to at least one of the data driver and the scan driver.

5. The digital driving system as claimed in claim 4, wherein the internal vertical synchronizing signal is generated in accordance with the main clock.

6. The digital driving system as claimed in claim 2, wherein the read memory control stage is adapted to supply the internal vertical synchronizing signal and a halved internal vertical synchronizing signal to the vertical synchronizing signal synchronizing circuit.

7. The digital driving system as claimed in claim 1, wherein the vertical synchronizing signal synchronizing circuit is adapted to determine a phase difference between the external vertical synchronizing signal and the internal vertical synchronizing signal, to control a frequency of the main clock in accordance with the phase difference, and to feedback a frequency controlled main clock to the timing controller.

8. The digital driving system as claimed in claim 7, wherein the timing controller is adapted to generate the internal vertical synchronizing signal in accordance with the frequency controlled main clock.

9. The digital driving system as claimed in claim 7, wherein the vertical synchronizing signal synchronizing circuit is adapted to increase the frequency of the main clock when the external vertical synchronizing signal leads the internal vertical synchronizing signal control.

10. The digital driving system as claimed in claim 7, wherein the vertical synchronizing signal synchronizing circuit is adapted to decrease the frequency of the main clock when the internal vertical synchronizing signal leads the external vertical synchronizing signal control.

11. The digital driving system as claimed in claim 1, further comprising a filter adapted to receive the phase difference from the third stage and output a DC component of the phase difference to the fourth stage.

12. The digital driving system as claimed in claim 1, wherein the display is an organic light emitting display.

13. A display, comprising:

a plurality of scan lines;

a plurality of drive lines;

a plurality of pixels at an intersection of corresponding scan and data lines; and a driver, the driver including a scan driver adapted to supply scan signals serially to scan lines of the display, a data driver adapted to supply a first data signal and a second data signal to data lines of the display, a timing controller adapted to control the scan driver and the data driver in accordance with a main clock, and to supply external data to the data driver, and a vertical synchronizing signal synchronizing circuit adapted to synchronize an internal vertical synchronizing signal and an external vertical synchronizing signal, wherein the vertical synchronizing signal synchronizing circuit includes:

a first stage adapted to receive the external vertical synchronizing signal and to output a halved external vertical synchronizing signal, a second stage adapted to receive the internal vertical synchronizing signal and a halved internal vertical synchronizing signal from the timing controller, and to output a shifted halved internal vertical synchronizing signal, a third stage adapted to determine a phase difference between the halved external vertical synchronizing signal and the shifted halved internal vertical synchronizing signal, and a fourth stage adapted to control a frequency of the main clock in accordance with the phase difference and to feedback the controlled main clock to the timing controller.

14. The display as claimed in claim 13, wherein the pixels include organic light emitting diodes.

* * * * *